US006254466B1

(12) United States Patent
Mucciacciaro et al.

(10) Patent No.: US 6,254,466 B1
(45) Date of Patent: Jul. 3, 2001

(54) ABRADING AND POLISHING TUMBLER APPARATUS

(75) Inventors: Domenic Mucciacciaro, 1791 Blount Rd., Ste. 901, Pompano Beach, FL (US) 33069; Alvin S. Blum, Fort Lauderdale, FL (US)

(73) Assignee: Domenic Mucciacciaro, Boca Raton, FL (US)

( * ) Notice: Subject to any disclaimer, the term of this patent is extended or adjusted under 35 U.S.C. 154(b) by 0 days.

(21) Appl. No.: 09/571,155

(22) Filed: May 16, 2000

(51) Int. Cl.[7] ..... B24B 31/02

(52) U.S. Cl. ..... 451/328; 451/104; 451/32; 451/30

(58) Field of Search ..... 451/328, 104, 451/32.1; 69/30; 99/605, 630; 118/19, 417; 241/176; 366/220; 422/209; 134/120, 117; 221/235, 237, 234, 233

(56) References Cited

U.S. PATENT DOCUMENTS

| | | | | |
|---|---|---|---|---|
| 2,912,803 | * | 11/1959 | Simjian | 451/328 |
| 3,326,404 | * | 6/1967 | Gardner | 220/24.5 |
| 3,553,902 | | 1/1971 | Christensen . | |
| 3,579,921 | | 5/1971 | Bobo . | |
| 3,765,131 | | 10/1973 | Christensen . | |
| 4,021,971 | | 5/1977 | McFadden . | |
| 4,045,918 | | 9/1977 | Freedman . | |
| 4,232,486 | * | 11/1980 | Rampe | 451/328 |
| 4,380,302 | * | 4/1983 | Broad | 220/235 |
| 5,486,135 | | 1/1996 | Arpaio . | |
| 6,170,690 | * | 1/2001 | Hosoi | 220/238 |

* cited by examiner

*Primary Examiner*—Joseph J. Hail, III
*Assistant Examiner*—G. Nguyen
(74) *Attorney, Agent, or Firm*—Alvin S. Blum

(57) ABSTRACT

A tumbler apparatus for abrading and polishing small parts and rocks includes a cylindrical barrel with a closed end and an open end. The inner surface at the open end has a circular sealing edge. A sealing closure for the sealing the barrel at the open end includes a first and a second rigid disc. A resilient band, either an O-ring or a cylinder, is held between the discs. A translating mechanism draws the discs toward one another in a sealing mode, that compresses the band to bulge outwardly to sealingly engage the inner sealing surface of the barrel open end. In a releasing mode, the discs are moved apart, allowing the band to resume it original shape, thereby unsealing the barrel to facilitate removal of the closure for access to the barrel contents. A pressure relief valve at the center of the discs may be optionally provided.

26 Claims, 4 Drawing Sheets

23'
25'
30
10
31
32
33
20'
19'
18'
17
14'
36
7'
6'

ABRADING AND POLISHING TUMBLER APPARATUS

BACKGROUND OF THE INVENTION

This invention relates to the field of tumblers or rumbles for abrading and/or polishing small parts or rocks, and more particularly to improved tumbler barrels and sealing closures therefor.

DESCRIPTION OF THE PRIOR ART

In the abrading and polishing of rough stones and certain small parts, it is common practice to seal the objects into a cylindrical drum or barrel along with a grinding medium and liquid. The barrel, or tumble, is then laid on its side on rollers. The tumble is then slowly rotated for many hours, or overnight. The devices described in U.S. Pat. Nos. 3,553,902 and 3,765,131, issued to Christensen, have been in popular use for many years. Although they have been very effective, there have been certain problems associated with their use. The closure is well sealed to prevent even a small leak, because of the long rotation times. Even with the tight seal, they do occasionally leak. Another problem is that it is often difficult to open the closure at the end of the polishing period. The barrel must be made of rubber, or similar material, which is expensive to fabricate. The seal is achieved by a closure having an outer flange that forces the outer end of the barrel inwardly against a rubber coated disc inside the barrel. When a vacuum forms inside the barrel, pulling the closure off is very difficult.

SUMMARY OF THE INVENTION

It is accordingly an object of the invention to provide a tumble apparatus that will not leak, that is less expensive to manufacture, and that is easy to open. It is another object that the barrel be manufacturable of a less expensive rigid material, such as an injection moldable plastic.

The tumbler apparatus of the invention comprises a cylindrical barrel with a body portion having a closed end face, an open opposite end having a circular inner sealing edge, and a resealable closure for the open end comprising a first rigid disc having a smaller diameter than the inner sealing edge, and a second rigid disc having a diameter at least as great as the first disc. Translating means are provided for forcing the two discs toward one another. Interposed between the two discs is a resilient band having a smaller diameter than the inner edge and arranged to be squeezed between the two discs as they are forced together in such fashion that the band bulges outwardly.

When the first disc is positioned within the inner sealing edge at the time that the two discs are forced together, the resilient band will be pressed against the circular inner sealing edge as it bulges outwardly, thereby tightly sealing the contents within the barrel. When the two discs are no longer forced together, the resilient band returns to its original shape, releasing any vacuum, and the closure is freely removable from the barrel. The reason the Christensen closure leaks may be because pressure builds up in the barrel. Because the leak is at the perimeter of the closure, fluid will drain out. The closure of the instant invention is provided with a pressure relief valve located at the axis of rotation, where there will be minimal leakage, even if the relief valve is forced open by internal pressure.

These and other objects, features, and advantages of the invention will become more apparent when the detailed description is studied in conjunction with the drawings in which like elements are designated by like reference characters in the various drawing figures.

DETAILED DESCRIPTION OF PREFERRED EMBODIMENTS

Figure 1:
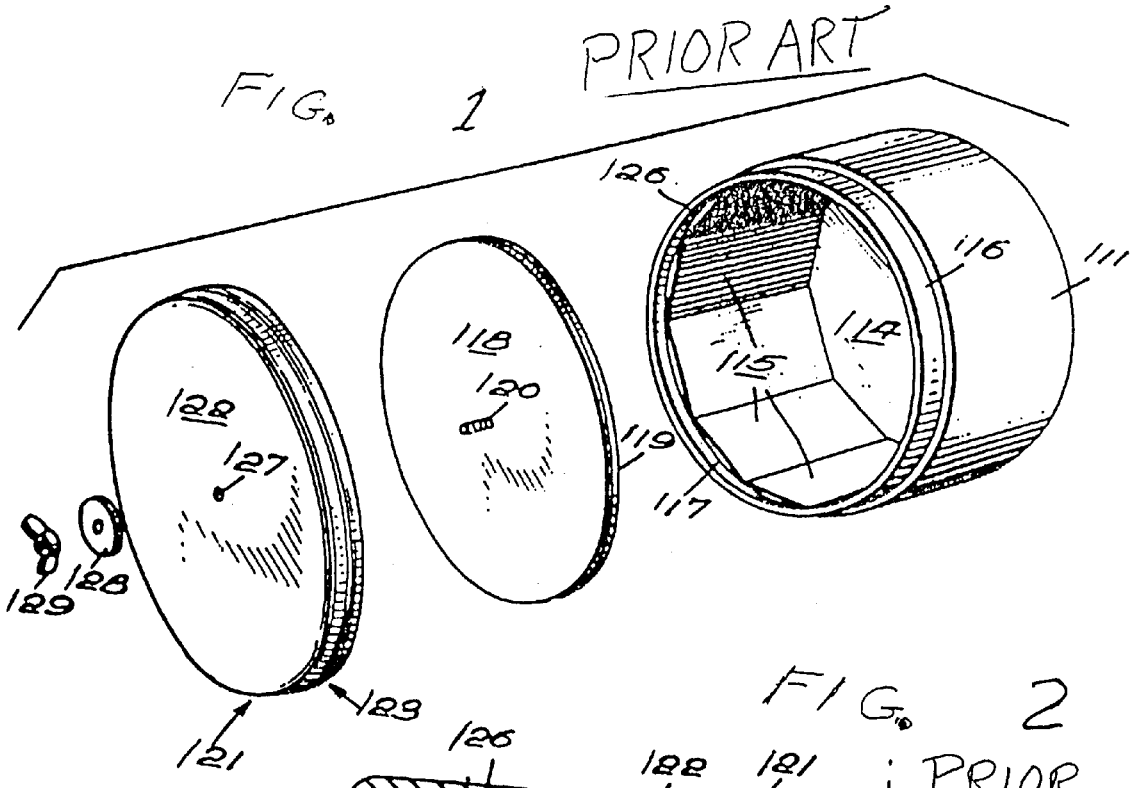
FIG. 1 PRIOR ART
FIG. 1 is an exploded perspective view of a prior art tumbler.
Figure 2:
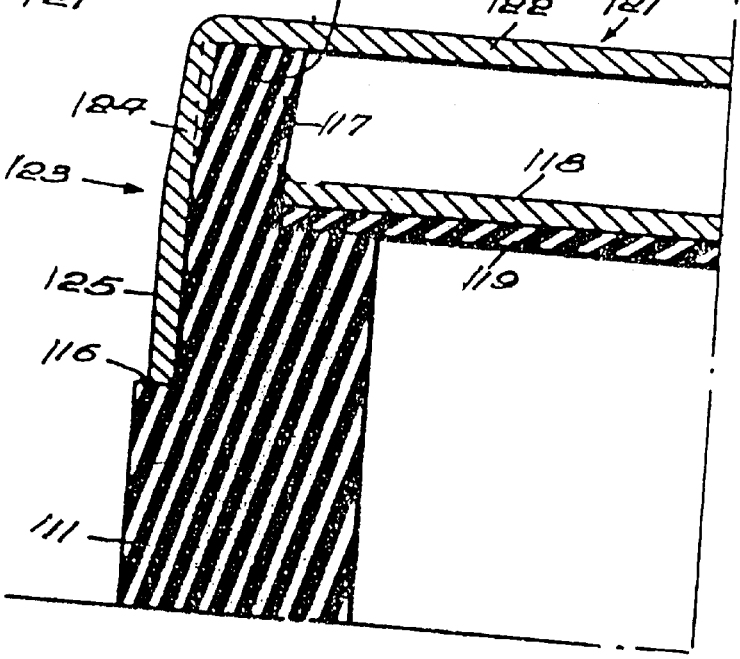
FIG. 2 PRIOR ART
FIG. 2 is a partial sectional view of the prior art tumbler of FIG. 1.

Referring now to the drawing FIGS. 1 and 2 of the prior art apparatus, the barrel 111 is made of rubber. It has an outer cylindrical surface with a notch 116 for receiving the flange 123 of the upper cover plate 122. The inner surface of the open end 126 is also notched at 117 to provide a smooth cylindrical inner surface. Being notched both inside and outside, a terminal barrel flange is formed that is yielding to the tapered upper portion 124 of the cover flange by bending inwardly. The rubber covered inner disc 118 is then drawn up against the bent rubber flange by screwing wing nut 129. This provides a reasonably secure closure. However, if pressure builds up in the sealed barrel, the cover will be forced open. Because the barrel is being slowly rotated on its side, any liquid will leak out the perimeter, which will be at the bottom of the chamber. When a vacuum forms in the sealed chamber, by cooling of the contents or ambient pressure changes, it is often extremely difficult to open the cover.

Figures 3, 4:
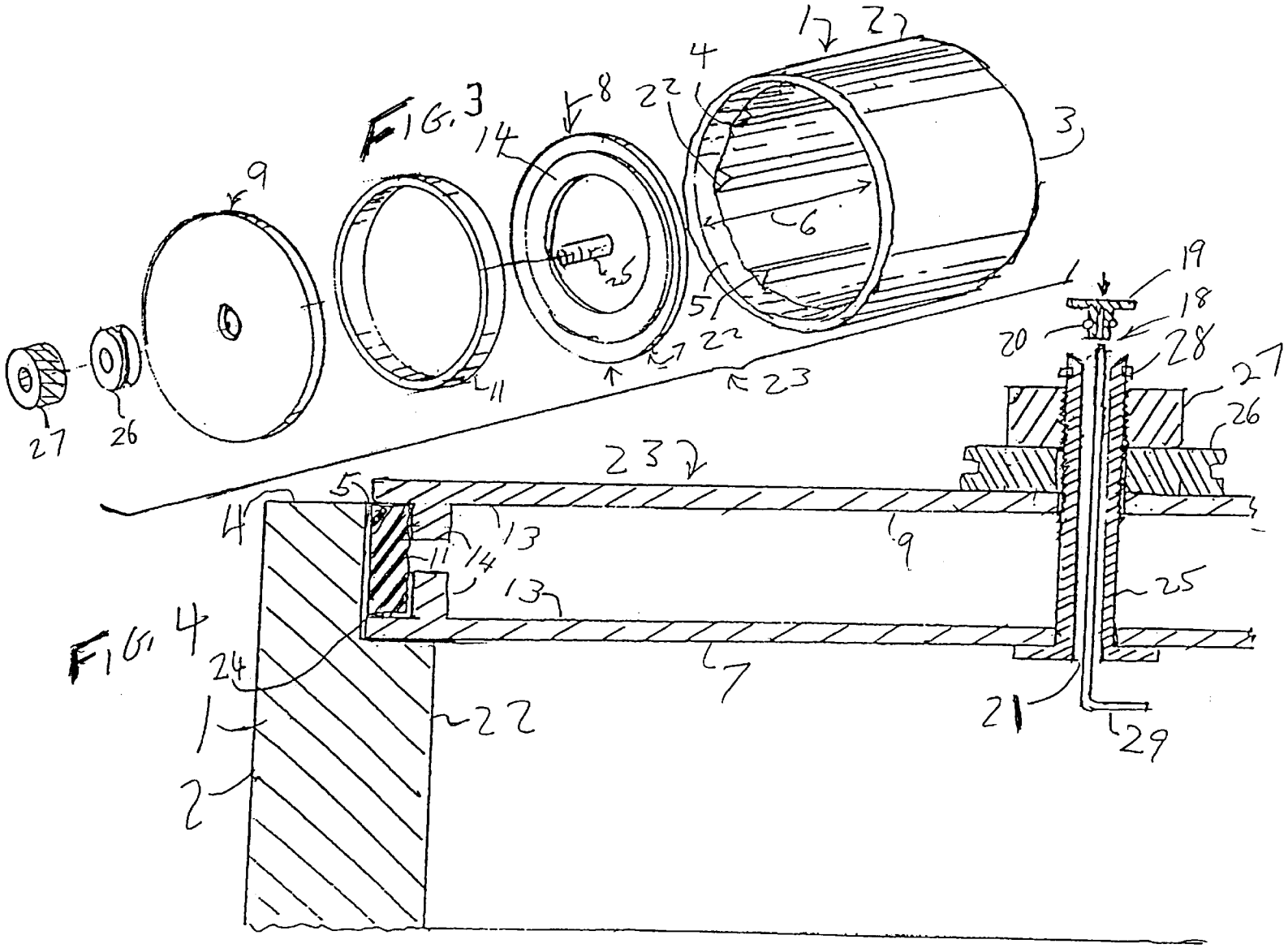
FIG. 3 is an exploded perspective view of the tumbler apparatus of the invention.
FIG. 4 is a partial sectional view of the tumbler of FIG. 3.

Referring now to FIGS. 3 and 4, a barrel 1 of the invention may have the internal facets 115 shown in FIG. 1, the radial flutes 22 shown in FIG. 3, or other configurations well known in the art for enhanced tumbling action. The barrel 1 has a cylindrical outer surface 2, a closed end 3, and an open end 4. It may be fabricated of a rigid material that is more economical to produce, since the yielding upper flange taught by Christensen is no longer required, or desirable. If the closure 23 is to be retrofitted to a barrel of the type shown in FIGS. 1 and 2, then it may be desirable to apply a non-stretchable band, not shown, onto the notch 116 so that it will not yield. An inner notch 24 at the open end 4 of the barrel 1 of FIG. 3 provides a smooth inner cylindrical sealing surface 5 with an inside diameter 6. The closure 23 comprises: a first disc 7 having a diameter 8 less than that of inner surface diameter 6, to permit free movement into and out of the barrel; a second disc 9 having a diameter at least as great as that of the first disc; a resilient band 11 in the shape of a short cylinder is interposed between the two discs; a flanged, threaded tubulation 25 sealed to the center of first disc 7 passes freely through second disc 9; a threaded knurled nut 27 for engaging tubulation 25 and drawing the discs together; and projections 14 on opposed faces 13 of the discs for holding the band 11 in position where it will be squeezed between the closing discs. The band may be made of rubber or material having similar properties such as soft polyurethane rubber or thermoplastic elastomers, for example. Interposed between the nut 27 and disc 9 may be a grooved bushing 26 that engages a stationary tab on the well known rotating apparatus, not shown. This threaded translating mechanism 16 causes the band to deform by bulging outwardly to seal against the inner surface 5 of the barrel in a sealing mode when the nut is tightened. The resilience of the band causes it to return to its original shape when the nut is unscrewed to the releasing mode of operation. Locking ring 28 holds the nut captive. Held captive within the channel 21 of tubulation 25 is a pressure relief valve 18 designed to keep the contents of the barrel sealed under ordinary conditions, and to open a fluid communication to the outside when the internal pressure exceeds a preset value. The valve 18 comprises a plug 19 with O-ring 20 that fits tightly within the channel 21. A bent rod 29 sealed into plug 19 holds the plug captive in the event the plug is blown out by internal pressure. The rod is small enough in diameter to not interfere with venting function.

Figures 5, 6:
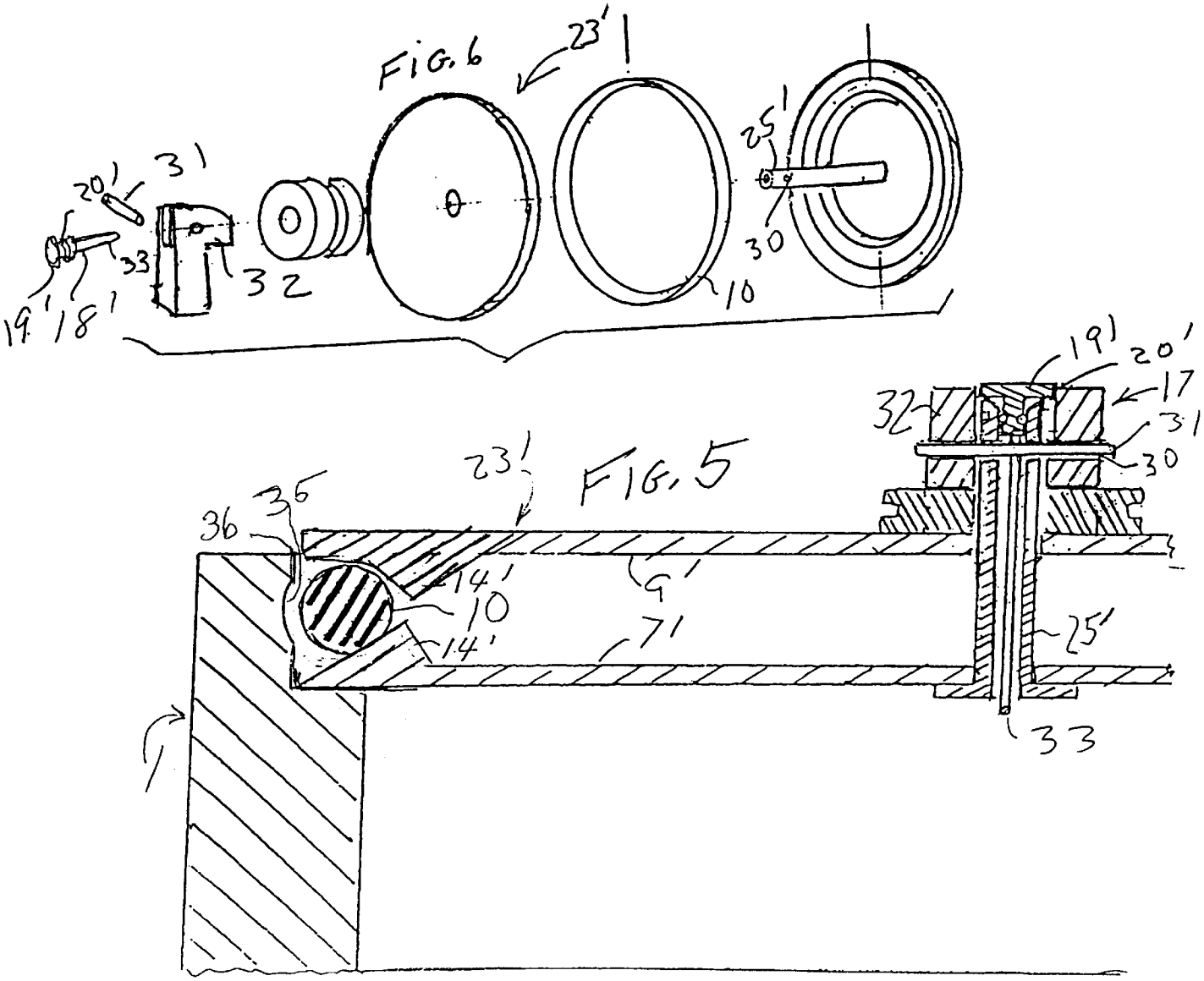
FIG. 5 is a partial sectional view of another embodiment of the invention.
FIG. 6 is an exploded perspective view of the closure of FIG. 5.

Referring now to the embodiment of the invention shown in FIGS. 5 and 6, a closure 23' fits into barrel 1. Its resilient sealing band 10 is an O-ring held in place by ring shaped projections 14' on first disc 7' and second disc 9'. The translating mechanism 17 for drawing the discs together for the sealing mode comprises a flanged tubulation 25' sealed to disc 7'. A perforation 30 in the side of the tubulation receives a roll pin 31 that holds in place cam member 32 and pressure valve 18'. The cam 32 is shown in sealing position in FIG. 6, and release position in FIG. 5. The pressure release valve 18' comprises a plug 19' with O-ring 20'. A U-shaped wire member 33 is sealed into the plug to hold the plug captive. An advantage of the cam locking translating mechanism is that it always applies a preset closing motion to the discs. A slight indentation 35 in the inner sealing edge 36 of the barrel 1' enhances retention of the O-ring when sealed.

Figure 7:
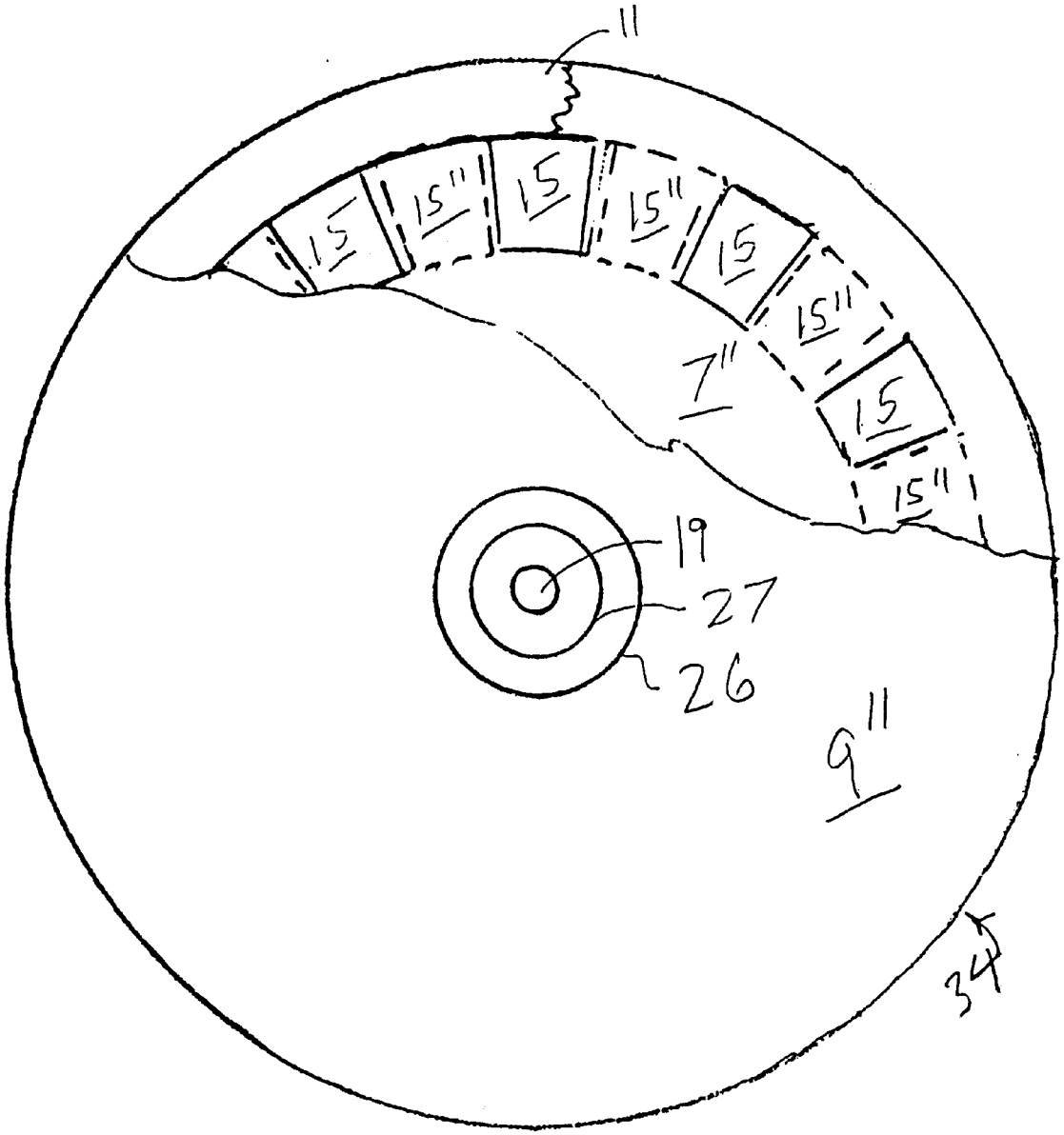
FIG. 7 is a top plan view of another embodiment of a closure of the invention, partially broken away.

Referring now to FIG. 7, another embodiment of the invention in the form of closure 34 is shown with the second disc 9" partially broken away to reveal the cylindrical resilient band 11 partially broken away, and the first disc 7". A plurality of individual projections 15 extend upwardly from the inner face of disc 7". These are arranged in a circle to fit inside band 11. Extending downwardly from the inner face, not shown, of disc 9" are a similar plurality of projections 15" shown in phantom. The two sets of projections fit between each other, or interdigitate, to provide a substantially continuous engagement of the inner diameter of the band during compression. This ensures a more secure sealing against the barrel.

The invention disclosed above has a number of particular features that should preferably be employed in combination, although each is useful separately without departure from the scope of the invention. While we have shown and described the preferred embodiments of our invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. Abrading and polishing apparatus comprising:

a) a barrel having an outer cylindrical surface, a bottom closed end, and a top open end, the top open end having a non-yielding circular inner sealing surface with an inside diameter, and receiving and dispensing parts and polishing agent therethrough, the closed bottom end being flat and adapted for standing on a support surface while parts and polishing agent are received through the top open end and while the open end is being sealed;

b) a rigid first disc having a diameter less than said inside diameter and adapted for insertion into said open end;

c) a rigid second disc having a diameter at least as great as that of the first disc;

d) a resilient band having an outside diameter less than said inside diameter, the band positioned between the first and second discs, and arranged to be compressed and to bulge outwardly and press sealingly against the inner sealing surface when the first and second discs are forced toward one another;

e) the first and second discs having opposed faces provided with projections that fit at least partially inside of the resilient band; and f) a translating mechanism for drawing the discs toward one another in a sealing first mode of operation and away from one another in a releasing second mode of operation.

2. The apparatus according to claim 1 further comprising a pressure relief valve providing a straight continuous fluid communication between the inside of the barrel and the outside of the second disc at the center of the first and second discs when pressure within the barrel exceeds a preset value.

3. The apparatus according to claim 2, in which the translating mechanism includes a screw threaded member.

4. The apparatus according to claim 2, in which the translating mechanism includes a cam member.

5. The apparatus according to claim 3, in which the resilient band is an O-ring.

6. The apparatus according to claim 3, in which the resilient band is a cylinder.

7. The apparatus according to claim 4, in which the resilient band is an O-ring.

8. The apparatus according to claim 4, in which the resilient band is a cylinder.

9. The apparatus according to claim 1, in which the projections of the first disc interdigitate with the projections of the second disc.

10. A closure for an abrading and polishing apparatus having a barrel with an outer cylindrical surface, a bottom closed end, and a top open end, the top open end having a non- yielding circular inner sealing surface with an inside diameter, and receiving and dispensing parts and polishing agent therethrough, the closed bottom end being flat and standing on a support surface while parts and polishing agent are received through the top open end and while the open end is being sealed, the closure comprising:

a) a rigid first disc having a diameter less than said inside diameter and adapted for insertion into said open end;

b) a rigid second disc having a diameter at least as great as that of the first disc;

c) a resilient band having an outside diameter less than said inside diameter, the band positioned between the first and second discs, and arranged to be compressed and to bulge outwardly and press sealingly against the inner sealing surface when the first and second discs are forced toward one another;

d) the first and second discs having opposed faces provided with projections that fit at least partially inside of the resilient band; and e) a translating mechanism for drawing the discs toward one another in a sealing first mode of operation and away from one another in a releasing second mode of operation.

11. The closure according to claim 10 further comprising a pressure relief valve providing a straight continuous fluid communication between the inside of the barrel and the outside of the second disc at the center of the first and second discs when pressure within the barrel exceeds a preset value.

12. The closure according to claim 11, in which the translating mechanism includes a screw threaded member.

13. The closure according to claim 11, in which the translating mechanism includes a cam member.

14. The closure according to claim 12, in which the resilient band is an O-ring.

15. The closure according to claim 12, in which the resilient band is a cylinder.

16. The closure according to claim 13, in which the resilient band is an O-ring.

17. The closure according to claim 13, in which the resilient band is a cylinder.

18. The closure according to claim 10, in which the projections of the first disc interdigitate with the projections of the second disc.

19. A closure for an abrading and polishing apparatus having a barrel with an outer cylindrical surface, a closed end, and an open end, the open end having a circular inner sealing surface with an inside diameter, the closure comprising:

a) a rigid first disc having a diameter less than said inside diameter and adapted for insertion into said open end;

b) a rigid second disc having a diameter at least as great as that of the first disc;

c) a resilient band having an outside diameter less than said inside diameter, the band positioned between the first and second discs, and arranged to be compressed and to bulge outwardly and press sealingly against the inner sealing surface when the first and second discs are forced toward one another;

d) a translating mechanism for drawing the discs toward one another in a sealing first mode of operation and away from one another in a releasing second mode of operation; and e) a pressure relief valve providing a straight continuous fluid communication between the inside of the barrel and the outside of the second disc at the center of the first and second discs when pressure within the barrel exceeds a preset value.

20. The closure according to claim 19, in which the translating mechanism includes a screw threaded member.

21. The closure according to claim 19, in which the translating mechanism includes a cam member.

22. The closure according to claim 20, in which the resilient band is an O-ring.

23. The closure according to claim 20, in which the resilient band is a cylinder.

24. The closure according to claim 21, in which the resilient band is an O-ring.

25. The closure according to claim 21, in which the resilient band is a cylinder.

26. The closure according to claim 19, in which the projections of the first disc interdigitate with the projections of the second disc.

* * * * *